US007409798B2

(12) United States Patent
Freeby et al.

(10) Patent No.: US 7,409,798 B2
(45) Date of Patent: Aug. 12, 2008

(54) DEVICE FOR PROTECTING AN OBJECT FROM ENCROACHING ELEMENTS

(76) Inventors: James L. Freeby, 935 N. State St., Sigurd, UT (US) 84657; Alex Boyter, 70 S. State St., Sigurd, UT (US) 84657

( * ) Notice: Subject to any disclaimer, the term of this patent is extended or adjusted under 35 U.S.C. 154(b) by 920 days.

(21) Appl. No.: 10/668,830

(22) Filed: Sep. 23, 2003

(65) Prior Publication Data

US 2005/0072070 A1 Apr. 7, 2005

(51) Int. Cl.
*E02D 5/74* (2006.01)

(52) U.S. Cl. ..... 52/166; 52/721.5; 52/169.8; 52/170

(58) Field of Classification Search ..... 52/166, 52/721.5, 169.8, 170, 723.2; 405/303, 50; 166/187

See application file for complete search history.

(56) References Cited

U.S. PATENT DOCUMENTS

| | | | | | |
|---|---|---|---|---|---|
| 237,172 | A * | 2/1881 | Dentler | 52/166 |
| 729,176 | A | 5/1903 | Hodges | |
| 1,532,734 | A | 4/1925 | Dean | |
| 2,064,936 | A * | 12/1936 | McQuiston | 166/294 |
| 2,642,268 | A * | 6/1953 | Armentrout | 175/72 |
| 2,836,555 | A * | 5/1958 | Armentrout | 507/112 |
| 3,638,433 | A * | 2/1972 | Sherard | 405/50 |
| 3,946,569 | A * | 3/1976 | Stuber | 405/303 |
| 4,936,386 | A * | 6/1990 | Colangelo | 166/292 |
| 5,013,191 | A | 5/1991 | Kitanaka | |
| 5,026,214 | A * | 6/1991 | Beck, III | 405/240 |
| 5,048,605 | A * | 9/1991 | Toon et al. | 166/187 |
| 5,516,237 | A | 5/1996 | Hebant | |
| 5,548,923 | A | 8/1996 | Myer | |
| 5,746,031 | A | 5/1998 | Burns | |
| D443,937 | S | 6/2001 | Prokop | |
| D457,661 | S | 5/2002 | Goodall | |
| 6,399,544 | B1 * | 6/2002 | Fairchild et al. | 507/100 |
| 6,524,029 | B2 * | 2/2003 | Nobert et al. | 405/129.75 |
| 2002/0171073 | A1 | 11/2002 | O'Berry et al. | |

* cited by examiner

*Primary Examiner*—Basil Katcheves
(74) *Attorney, Agent, or Firm*—Kunzler & McKenzie

(57) ABSTRACT

Disclosed is a barrier for protecting an object from encroaching elements. In one embodiment, the object is a utility pole and the barrier comprises an organic bentonite-based material and an outer boundary surface. The organic bentonite-based material may be formed substantially of sodium bentonite. The outer boundary surface may be an annular plastic sheet. Alternatively, the outer boundary surface may comprise the edges of a depression formed around the utility pole. The barrier may be disposed about any object that requires protection from encroaching elements, such as, but not limited to, fences, fence posts, poles, buildings, etc.

18 Claims, 6 Drawing Sheets

DEVICE FOR PROTECTING AN OBJECT FROM ENCROACHING ELEMENTS

BACKGROUND OF THE INVENTION

1. Field of the Invention

This invention relates to protective devices for objects and more particularly relates to barriers which may be used to protect utility poles from encroaching elements.

2. Description of the Related Art

A utility pole is designed to support various lines and aid in their distribution. Some of the various lines that are supported on utility poles include telephone lines, television cables, and power or electric lines. Commonly, utility poles are made of one of two materials. The first material is metal.

Metal utility poles are preferred because the metal utility pole can be built to almost any size in order to accommodate many lines. Also, the metal utility pole is resistant to insects, fire, and water damage. However, metal utility poles are highly conductive and generally create an unsafe environment for the utility personnel that maintain and repair the pole. Additionally, metal poles can be expensive, and are relatively heavy, typically requiring a crane to lift and install the poles, and therefore are nearly impossible to install in remote locations without the help of a helicopter. For that reason, the traditional wood utility pole is still widely used.

Wooden utility poles are typically anchored into the ground. The utility poles will generally have arms that support a number of electrical power lines. The continuous exposure to harsh environmental conditions can cause wood poles to rot and decay. To prevent rotting, the wood is sometimes treated with a carbon based material such as tar. It has been found that most conventional wood treatments are harmful to the environment.

Additionally, wood utility poles are subject to insect infestation and fires. Insect and fire damage to wood utility poles is generally the result of plant growth around the base of the pole. To limit damage to wood utility poles due to insects and fires, one of two methods is typically employed. The first method consists of extending the cement that anchors the utility pole to a radius of about 3 feet around the base of the utility pole. While this is a very effective method for inhibiting growth, and thereby limiting insects and creating a fire break, extending the cement is not very economical. Furthermore, creating a cement barrier may be very difficult depending upon the location of the pole.

The second method for preventing growth around a pole is to spray a type of growth inhibitor around the pole. This is a very cost effective and easy to implement solution to the problem of overgrowth. However, the duration of the effectiveness of the spray is limited. Additionally, some states prohibit the use of such a spray as it may be harmful to the environment. Also, the spray does little to protect the base of the utility pole from water damage.

What is needed is a barrier that protects utility poles from foliage overgrowth. Beneficially, such a barrier would be environmentally-friendly, water resistant, inhibit foliage growth, and deter insects.

BRIEF SUMMARY OF THE INVENTION

The present invention has been developed in response to the present state of the art, and in particular, in response to the problems and needs in the art that have not yet been fully solved by currently available protection barriers. Accordingly, the present invention has been developed to provide a method, apparatus, and system for protecting an object from encroaching elements that overcome many or all of the above-discussed shortcomings in the art.

In one embodiment, the barrier for protecting an object from encroaching elements comprises an organic bentonite-based material and an outer boundary surface disposed to retain the material in a selected location, the location at least partially surrounding the object. The boundary surface comprises a retaining device configured to retain the material. The boundary surface may comprise an annular plastic sheet. Alternatively, the boundary surface may comprise the edges of a depression.

In a further embodiment, the object may comprise a pole. The material may be disposed surrounding the base of the pole. The material is disposed around the pole extending outward from the pole a distance of between about 6 inches to about 10 feet. Alternatively, the material may be disposed around the pole extending outward from the pole a distance of about 3 feet. Additionally, the material is disposed around the pole to a depth in the range of between about 0.25 inch and about 4 feet. In one embodiment, the material may be disposed around the pole to a depth of about 8 inches.

A method for protecting an object is also provided. In one embodiment, the method comprises providing an outer boundary surface disposed to retain a material in a selected location, the location at least partially surrounding the object, and depositing an organic bentonite-based material. Furthermore, the method may include providing an outer boundary surface which may comprise creating a depression about the object for holding the material. Alternatively, providing an outer boundary surface comprises installing a circular plastic sheet configured to retain the material.

Depositing the material may comprise depositing the material in a radius about the object, and/or depositing the material and forming an upward slope towards the object. In one embodiment, depositing the material comprises pumping the material from a source. Alternatively, depositing the material may comprise shoveling the material from the source.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE INVENTION

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Figure 1:
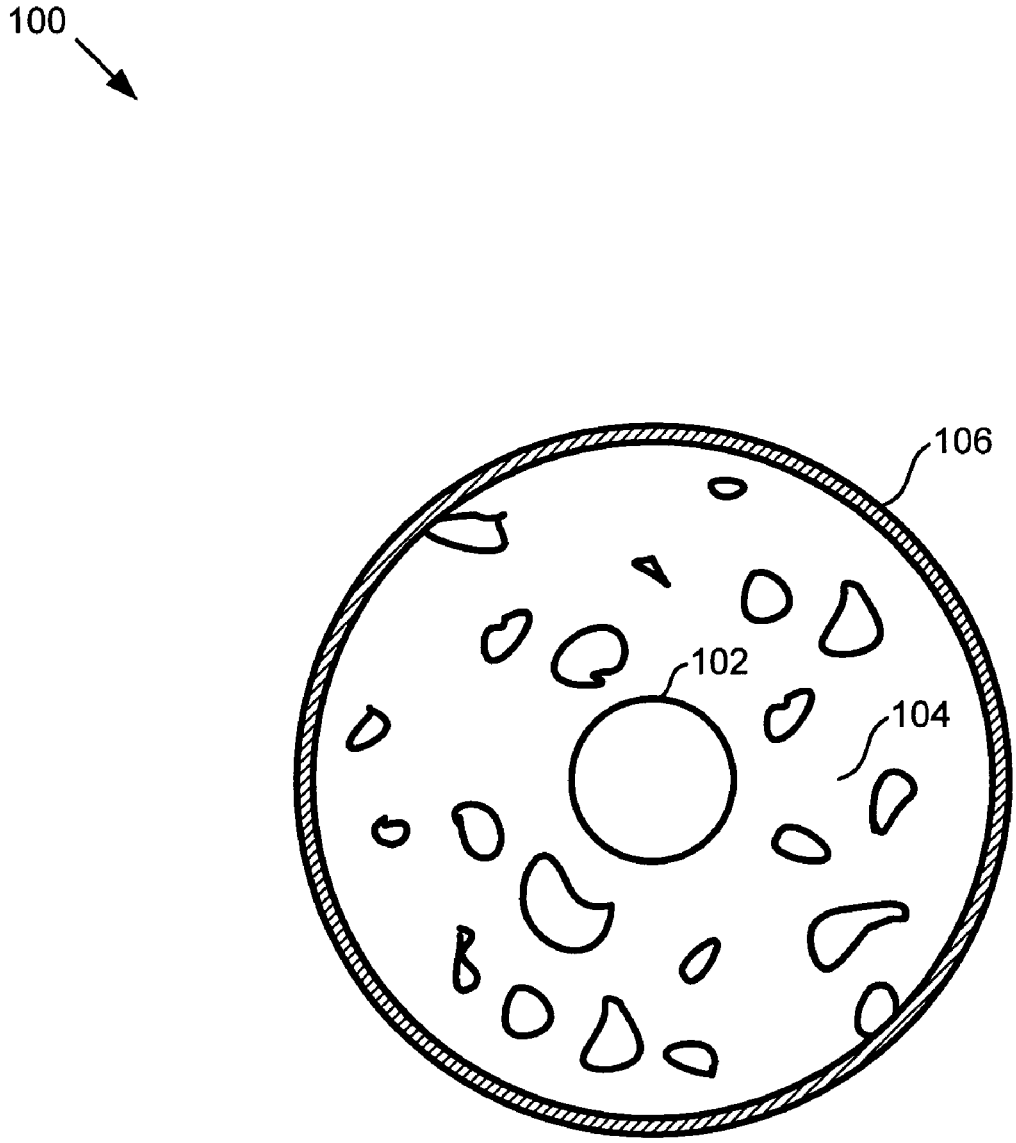
FIG. 1 is a schematic block diagram illustrating one embodiment of a barrier for protecting an object in accordance with the present invention.
Figure 2:
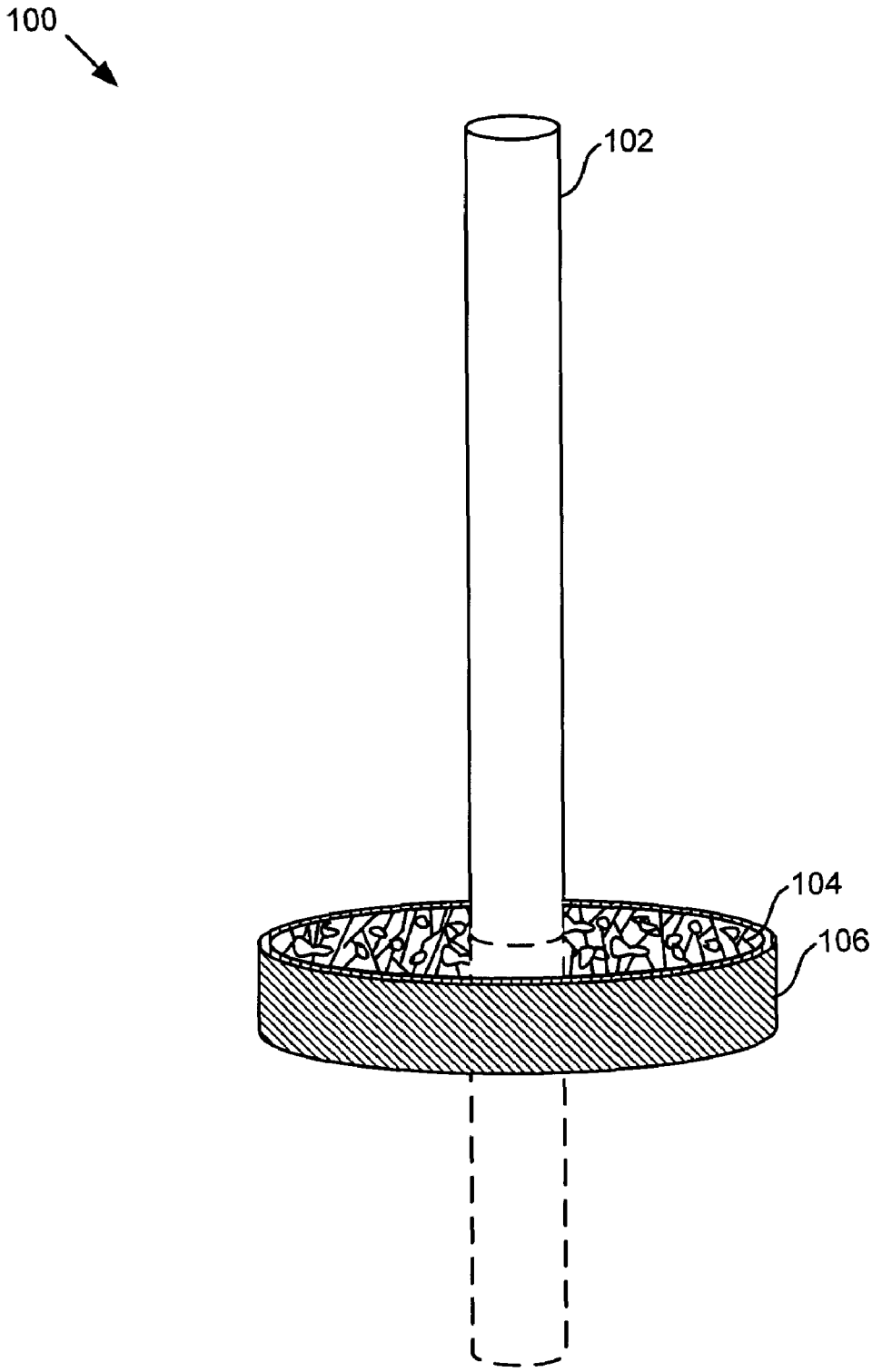
FIG. 2 is a side perspective view illustrating one embodiment of a barrier for protecting an object in accordance with the present invention.
Figure 6:
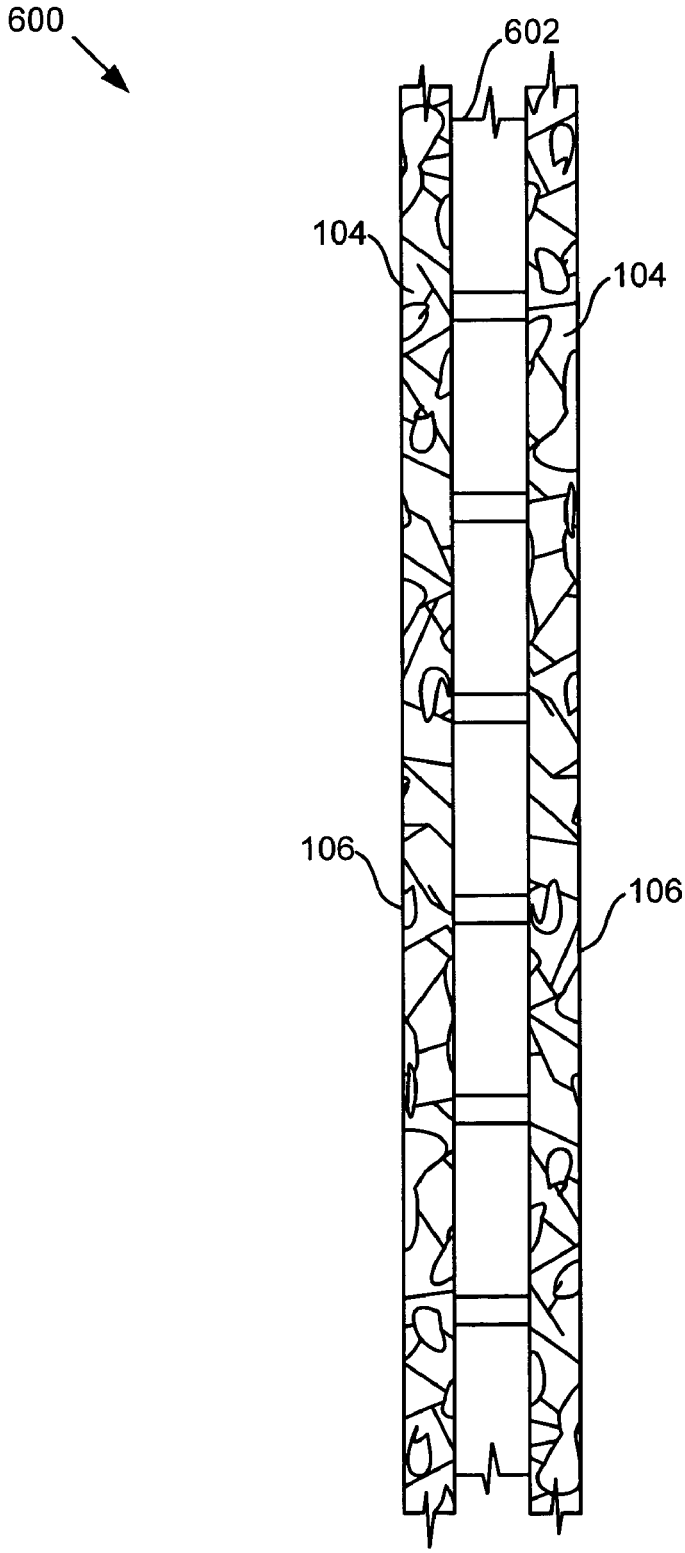
FIG. 6 is a schematic block diagram illustrating one embodiment of a barrier for protecting an object in accordance with the present invention.

Furthermore, the described features, structures, or characteristics of the invention may be combined in any suitable manner in one or more embodiments. One skilled in the relevant art will recognize, however, that the invention can be practiced without one or more of the specific details, or with other methods, components, materials, and so forth. In other instances, well-known structures, materials, or operations are not shown or described in detail to avoid obscuring aspects of the invention. FIG. 1 is a top view schematic block diagram illustrating one embodiment of a barrier 100 for protecting an object, such as a utility pole 102 from encroaching elements. In one embodiment the barrier 100 may comprise an organic bentonite-based material 104 and an outer boundary surface 106 for protecting the utility pole 102. The organic bentonite-based material 104 may comprise a mixture of primarily sodium bentonite. In one embodiment, the mixture comprises at least 50% bentonite. The remainder of the mixture may comprise soil, gravel, pebbles, and the like. FIGS. 1, 2, and 6 depict the material 104 with large pebbles. This illustration is by way of example only, in order to depict the organic nature of the material 104. Advantageously, sodium bentonite provides an environment that prevents growth around the utility pole 102 and is harmless to the environment. Specifically, the bentonite in the material 104 deprives seeds, roots, and plants of water and provides a salinity level which is detrimental to plant growth. This creates a region about the base of the utility pole 102 that may serve as a fire break in the event of a forest fire. Additionally, insects that may damage the utility pole 102, such as termites, are less likely to infest the utility pole 102 because the region is devoid of plant growth. Also, sodium bentonite absorbs water and swells to as much as fifteen times its mass, then forming a strong water and chemical proof seal that helps prevent rotting of the utility pole 102. The material 104 may also comprise mixtures formed substantially of, but not limited to, Bentonite, Smectite, Moutmorillonite, High Swelling Bentonite, Wyoming Bentonite, Western Bentonite, Texas Bentonite, Alumina Silicate Clay, or Hydrated Aluminum Silicate.

Referring now to FIG. 2, shown therein is a side perspective view diagram illustrating one embodiment of the barrier 100 with the utility pole 102 extending in to the ground. In one embodiment, the boundary surface 106 may comprise an annular plastic sheet configured to retain the material 104. One example of an annular plastic sheet is commonly available landscape edging. Similarly, the boundary surface 106 may be formed of, but is not limited to, cement, wood, or stone.

The barrier 100 may extend outward from the utility pole 102 a distance in the range of between about 6 inches and about 10 feet. Alternatively, the barrier 100 may extend outward from the utility pole 102 a distance in the range of between about 2 feet and 5 feet. Preferably, the barrier 100 extends from the base of the pole 102 to a distance of about 3 feet. Alternatively, the barrier 100 may extend outward from the base of the utility pole 102 any distance deemed necessary to protect the utility pole 102. Additionally, the barrier 100 may be disposed about the utility pole 102 in a manner resembling, but not limited to, a square, ellipse, rectangle, or any other shape having a polygonal cross-section.

The boundary surface 106 may have a height in the range of between about 0.25 inches and 4 feet. In a further embodiment, the boundary surface 106 may have a height in the range of between about 4 inches and 2 feet. Preferably, the boundary surface 106 may have a height of about 8 inches. Alternatively, the boundary surface 106 may have any height necessary to protect the utility pole 102.

Figure 3:
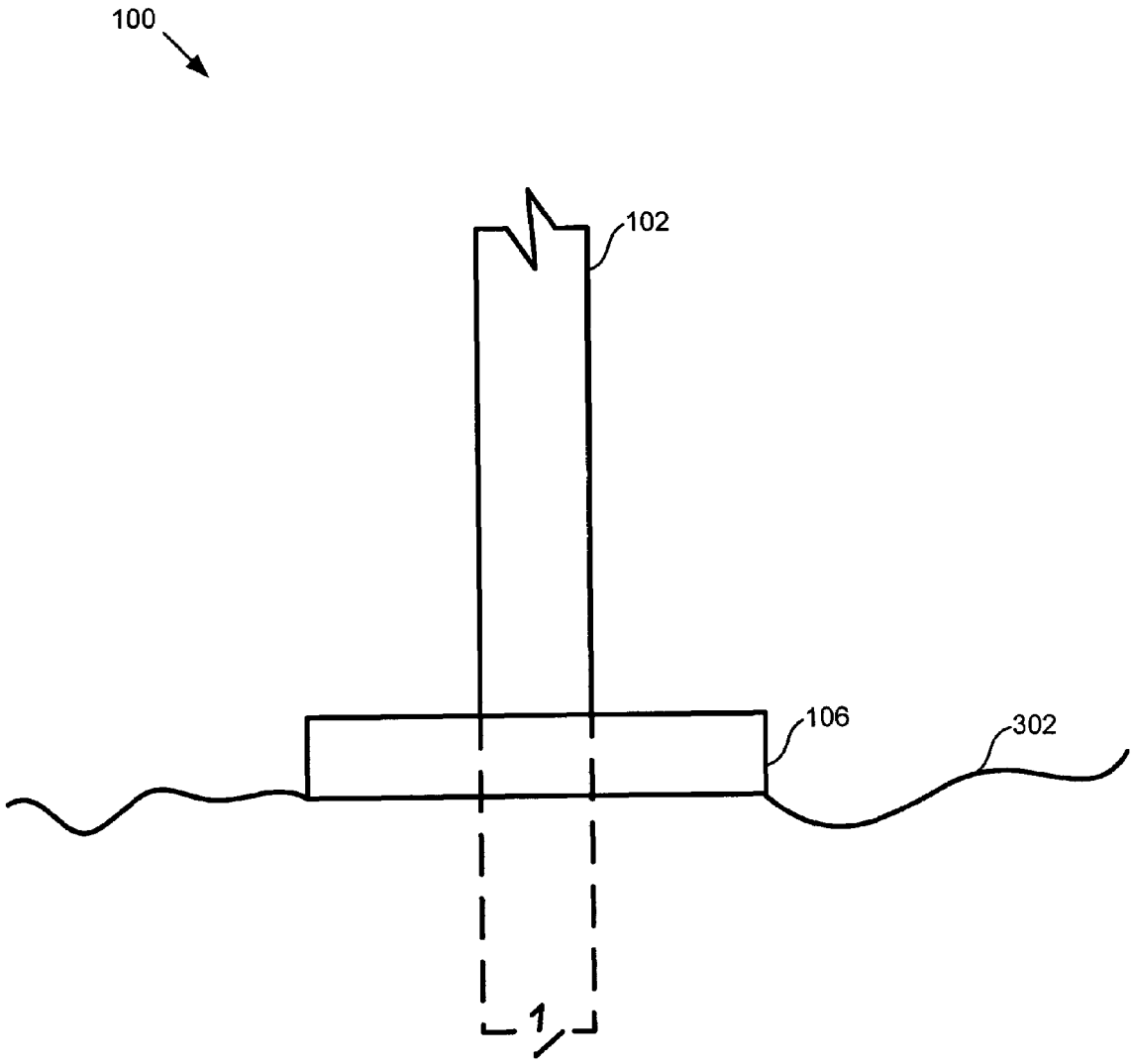
FIG. 3 is a schematic block diagram illustrating one embodiment of a barrier for protecting an object in accordance with the present invention.
Figure 4:
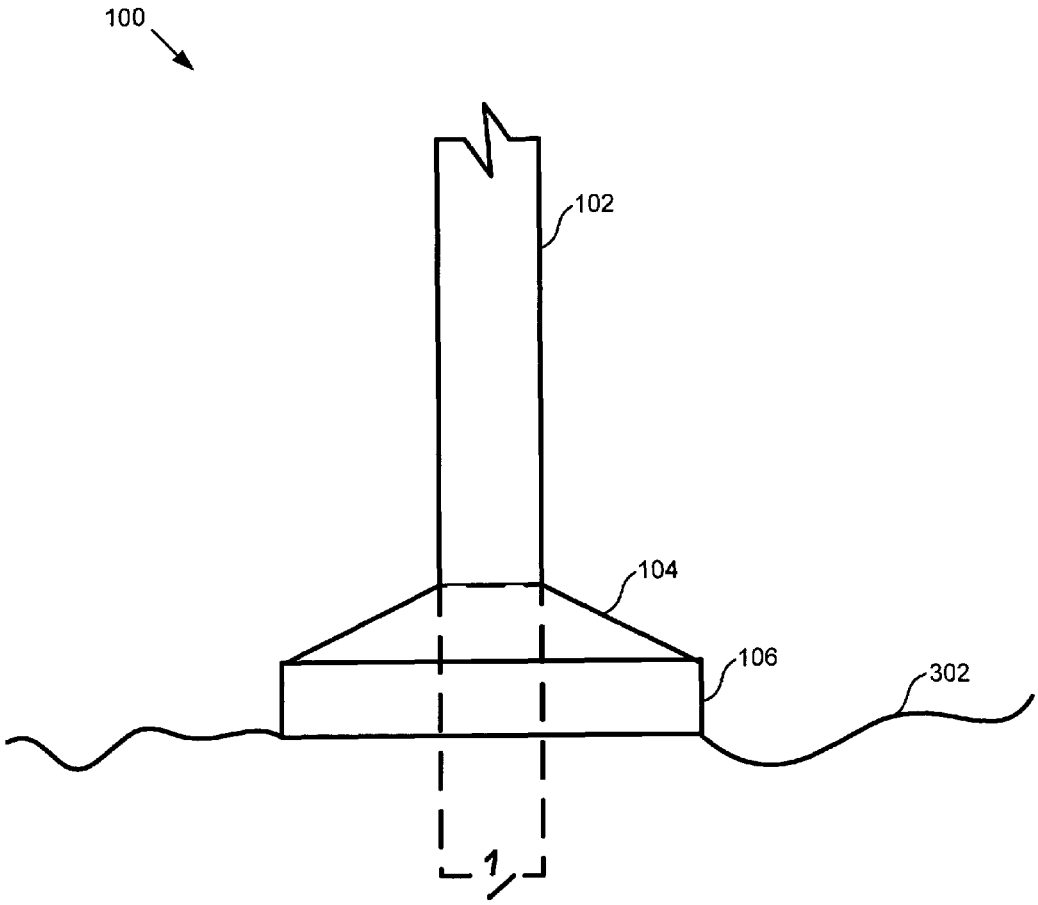
FIG. 4 is a schematic block diagram illustrating one embodiment of a barrier for protecting an object in accordance with the present invention.

Referring to FIGS. 3 and 4, shown therein are schematic block diagrams illustrating one embodiment of the barrier 100 of the present invention. In one embodiment, the barrier 100 maybe implemented above ground 302. For example, in order to implement the barrier 100 as depicted, the boundary surface 106 would be placed on the ground 302 and secured. Material 104 (not shown) would then be used to fill the cavity formed by the boundary surface 106. Due to the growth-inhibiting nature of the sodium bentonite material 104, it is not necessary to clear the area before depositing the material 104 around the utility pole 102. Additionally, the material 104 may be formed with an upward slope towards the utility pole as illustrated in FIG. 4.

Figure 5:
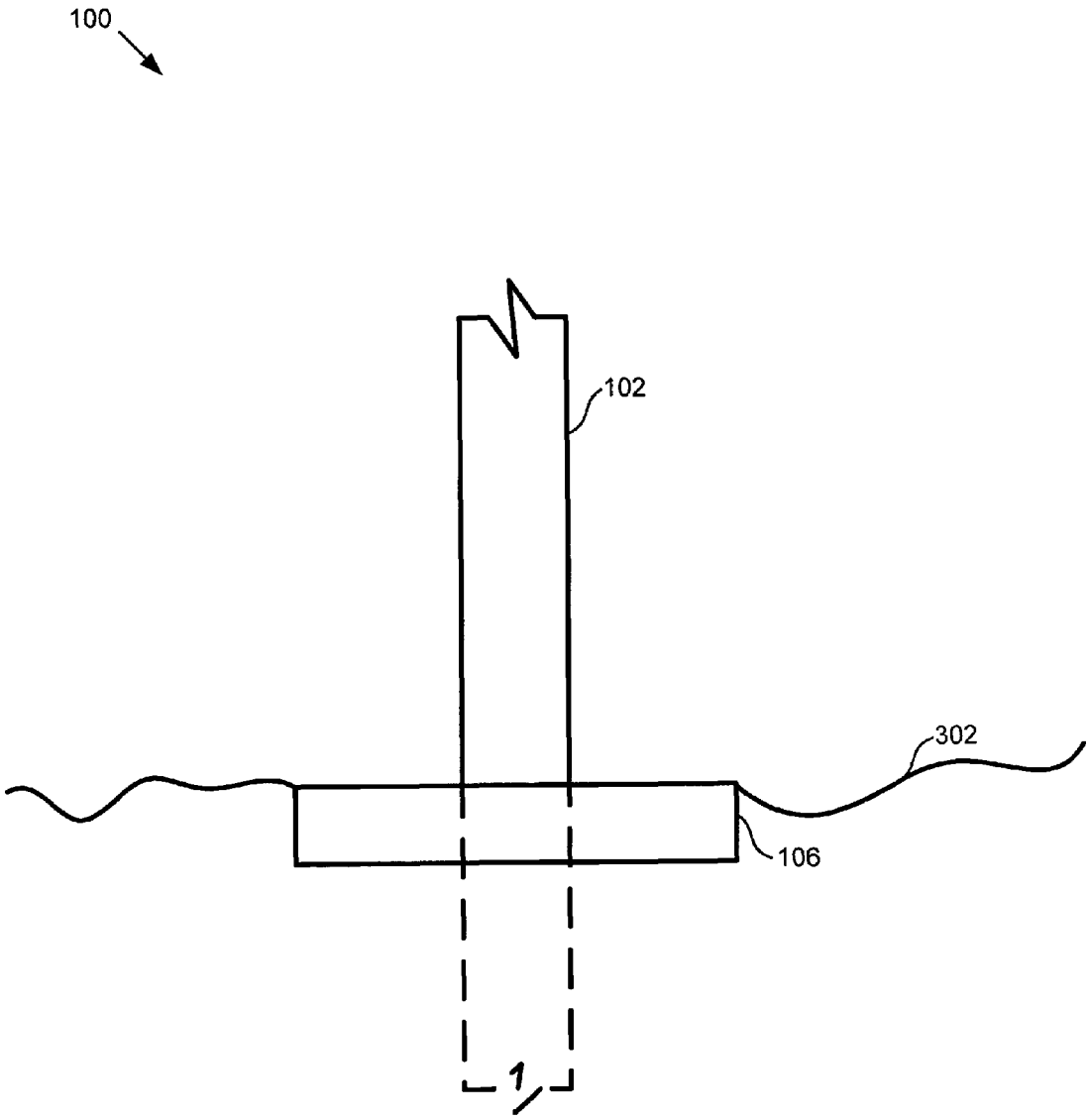
FIG. 5 is a schematic block diagram illustrating one embodiment of a barrier for protecting an object in accordance with the present invention.

FIG. 5 is a schematic block diagram illustrating one embodiment of the barrier 100 of the present invention. The barrier 100 maybe implemented below ground 302 as shown. In one embodiment, the boundary surface 106 may comprise the edges of a depression formed around the utility pole 102. A worker may implement the barrier 100 by digging around the utility pole 102 in order to form an area for depositing the material 104. The depth of the depression is in the range of between about 0.25 inches and about 4 feet. In a further embodiment the depth of the depression is in the range of between about 4 inches and about 2 feet. Preferably, the depth of the depression is about 8 inches.

Referring now to FIG. 6, shown therein is a top view schematic block diagram illustrating one embodiment of a barrier 600 of the present invention. The barrier 600 may comprise the material 104 and the boundary surface 106 disposed about a fence 602. Such an arrangement is beneficial for fences along the sides of highways where it is not feasible to maintain landscaping. The barrier 600 eliminates the need to cut weeds, grass, etc., from around the fence 602.

In one embodiment, the barrier 600 is implemented as a linear barrier running parallel to the fence 602 on one or both sides. The depth of the material 104 and boundary surface 106 may be implemented in a similar manner as above with reference to FIGS. 1 and 5. The barrier 600 may extend outward from the fence 602 a distance in the range of between about 1 inch and 4 feet. Preferably, the barrier 600 extends outward from the fence 602 a distance of about 3 feet.

The barrier 600 may also be disposed about any object that requires protection from encroaching elements. Such objects may include, but are not limited to, buildings, fences, fence posts, or poles.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A fire baffler protecting an object comprising:

an organic bentonite-based material;

an outer boundary surface disposed to retain the material in a selected location, the location at least partially surrounding the object, wherein the outer boundary surface comprises an annular plastic sheet;

wherein the organic bentonite-based material is disposed within the outer boundary surface such that a top surface of the material remains uncovered and exposed to the aboveground environment after disposing the bentonite-based material within the outer boundary; and the organic bentonite-based material forming a region about the object, the region configured to prevent plant growth and thereby protect the object from fire.

2. The fire barrier of claim 1, wherein the boundary surface comprises a retaining device configured to retain the material.

3. The fire barrier of claim 1, wherein the object comprises a pole.

4. The fire baffler of claim 3, wherein the material is disposed surrounding the base of the pole.

5. The fire barrier of claim 3, wherein the material is disposed around the pole extending outward from the pole a distance of between about 6 inches to about 10 feet.

6. The fire barrier of claim 3, wherein the material is disposed around the pole extending outward from the pole a distance of between about 2 inches and about 5 feet.

7. The fire barrier of claim 3, wherein the material is disposed around the pole extending outward from the pole a distance of about 3 feet.

8. The fire barrier of claim 3, wherein the material is disposed around the pole to a depth in the range of between about 0.25 inches and about 4 feet.

9. The fire barrier of claim 3, wherein the material is disposed around the pole to a depth in the range of between about 4 inches and about 2 feet.

10. The fire barrier of claim 3, wherein the material is disposed around the pole to a depth of about 8 inches.

11. The fire barrier of claim 1, wherein the boundary surface comprises the edges of a depression.

12. A method for protecting an object from fire, said method comprising:

preparing an area surrounding an object for receiving an outer boundary surface, the area extending from the object a distance suitable to keep vegetation outside the area from igniting the object;

disposing the outer boundary surface to retain a material in a location, the location at least partially surrounding the object, the outer boundary surface comprising a circular plastic sheet configured to retain a mixture; and depositing an organic bentonite-based mixture comprising at least 50% bentonite within the outer boundary surface, a top surface of the bentonite-based mixture remaining exposed to the aboveground environment after disposing the bentonite-based mixture within the outer boundary surface, the bentonite based mixture creating a hostile growing environment for vegetation.

13. The method of claim 12, wherein preparing an area comprises excavating a depression about the object for holding the mixture.

14. The method of claim 12, wherein depositing the mixture further comprises depositing the mixture in a radius about the object.

15. The method of claim 12, further comprising depositing the mixture and forming an upward slope towards the object.

16. The method of claim 12, wherein depositing the mixture further comprises pumping the mixture from a source.

17. The method of claim 12, further comprising adding bentonite to the bentonite based mixture in response to signs of vegetation growth within the bentonite based mixture.

18. A barrier protecting an object from fire comprising:

an organic object;

an organic bentonite-based mixture comprising at least 50% bentonite and up to 50% soil;

an annular plastic sheet disposed to retain the mixture in a selected location, the location at least partially surrounding the object;

the mixture is disposed around the object, between the plastic sheet and the object such that a top surface of the mixture remains uncovered and exposed to the aboveground environment after disposing the bentonite-based mixture between the plastic sheet and the object, and extending outward from the object a distance of about 3 feet and to a depth of about 8 inches; and wherein the organic bentonite-based mixture creates a hostile vegetation growth region about the object, absorbing water and maintaining a salinity level toxic to vegetation thereby protecting the object from combustion of vegetation within the location.

* * * * *

UNITED STATES PATENT AND TRADEMARK OFFICE

CERTIFICATE OF CORRECTION

PATENT NO. : 7,409,798 B2
APPLICATION NO. : 10/668830
DATED : August 12, 2008
INVENTOR(S) : James L. Freeby et al.

It is certified that error appears in the above-identified patent and that said Letters Patent is hereby corrected as shown below:

Column 5, line 22
"A fire baffler" should read --A fire barrier--

Column 5, line 40
"The fire baffler," should read --The fire barrier--

Signed and Sealed this

Seventh Day of October, 2008

JON W. DUDAS
*Director of the United States Patent and Trademark Office*